United States Patent [19]

Charest

[11] Patent Number: 5,031,811

[45] Date of Patent: Jul. 16, 1991

[54] CONVERTIBLE CHAIR AND LOAD CARRIER DEVICE

[76] Inventor: Emilien Charest, 247, rue Cartier, Lachenaie, Québec, Canada, J6W 5L7

[21] Appl. No.: 461,680

[22] Filed: Jan. 8, 1990

[30] Foreign Application Priority Data

Dec. 19, 1989 [CA] Canada ..... 2006014

[51] Int. Cl.[5] ..... A45F 4/02

[52] U.S. Cl. ..... 224/155; 224/201; 224/211; 224/214; 224/246; 224/250; 224/270; 297/283; 16/363

[58] Field of Search ..... 224/151, 153, 202, 205, 224/207, 209, 213, 210, 257-259, 261, 155, 201, 156, 211, 212, 214, 215, 216, 246, 250, 262, 263, 270; 297/283, 335, 2, 3; 16/363, 362, 364

[56] References Cited

U.S. PATENT DOCUMENTS

| | | | |
|---|---|---|---|
| 1,150,664 | 8/1915 | Cramer | 224/263 X |
| 1,723,147 | 8/1929 | Fourethier | 224/197 |
| 1,921,622 | 8/1933 | Korth | 16/364 X |
| 2,480,402 | 8/1949 | Elston | 297/129 |
| 2,498,428 | 2/1950 | Kruse | 224/261 X |
| 2,555,073 | 5/1951 | Zdankoski | 43/55 |
| 2,973,888 | 3/1961 | Beardsley | 224/156 X |
| 3,127,077 | 3/1964 | Faro | 224/210 |
| 3,266,686 | 8/1966 | Griffith | 224/155 |
| 3,292,830 | 12/1966 | Mack | 224/155 |
| 3,690,525 | 9/1972 | Koons | 224/155 |
| 3,822,422 | 7/1974 | Buntyn | 224/156 X |
| 3,957,183 | 5/1976 | Gadberry | 224/221 |
| 4,836,938 | 6/1989 | Kobasic | 224/155 |
| 4,847,950 | 7/1989 | Coleman | 16/363 |
| 4,934,573 | 6/1990 | Jaeger | 224/210 |
| 4,938,400 | 7/1990 | Springston | 224/155 |

FOREIGN PATENT DOCUMENTS

| | | | |
|---|---|---|---|
| 0802469 | 1/1951 | Fed. Rep. of Germany | 224/210 |
| 0474581 | 9/1952 | Italy | 224/210 |
| 0051075 | 6/1932 | Norway | 224/210 |
| 0394594 | 6/1933 | United Kingdom | 297/335 |
| 1085217 | 9/1967 | United Kingdom | 297/335 |

*Primary Examiner*—Henry J. Recla
*Assistant Examiner*—Casey Jacyna
*Attorney, Agent, or Firm*—Longacre & White

[57] ABSTRACT

The convertible chair and load carrier device includes a dorsal member, a load support member pivotally mounted on the dorsal member, and a harness for attaching the dorsal member on the back of a user person. The load support member can be pivoted between first and second positions and locked in either one of these two positions. In its first position, the load support member is capable of supporting a load to thereby allow the user person to carry it on his back. In the second position of the load support member, this member forms the seat of a chair and the dorsal member the back of the same chair.

9 Claims, 5 Drawing Sheets

2
11
36
58
42
49
48
3
56
3
55
57
47
59
51
3
52
53
54

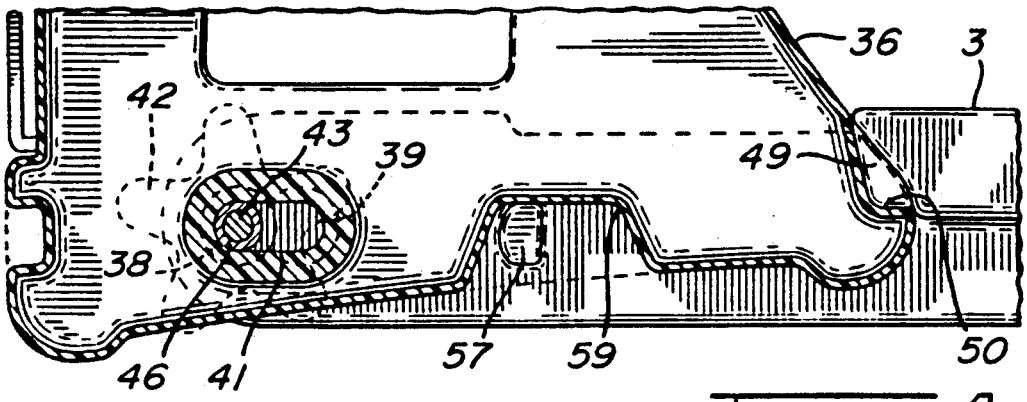
FIG. 4
FIG. 5
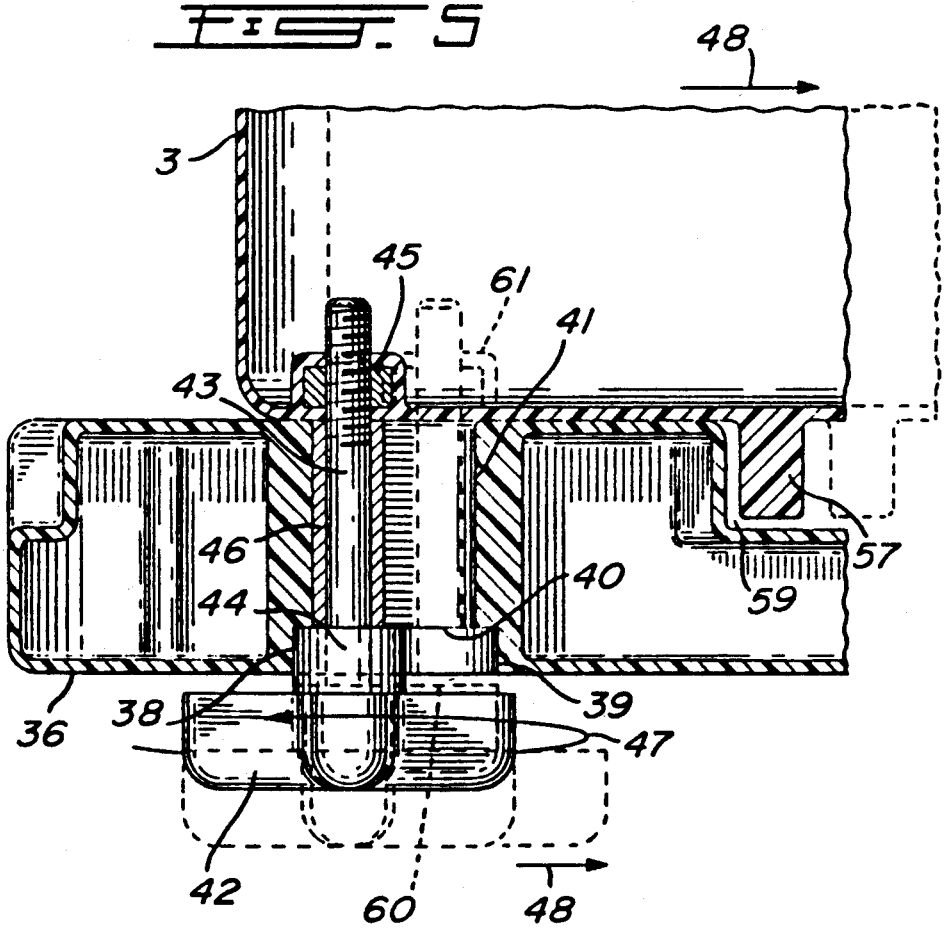
FIG. 6
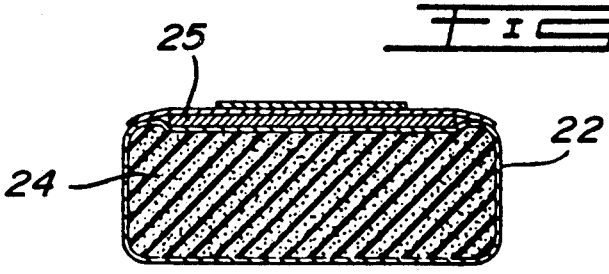

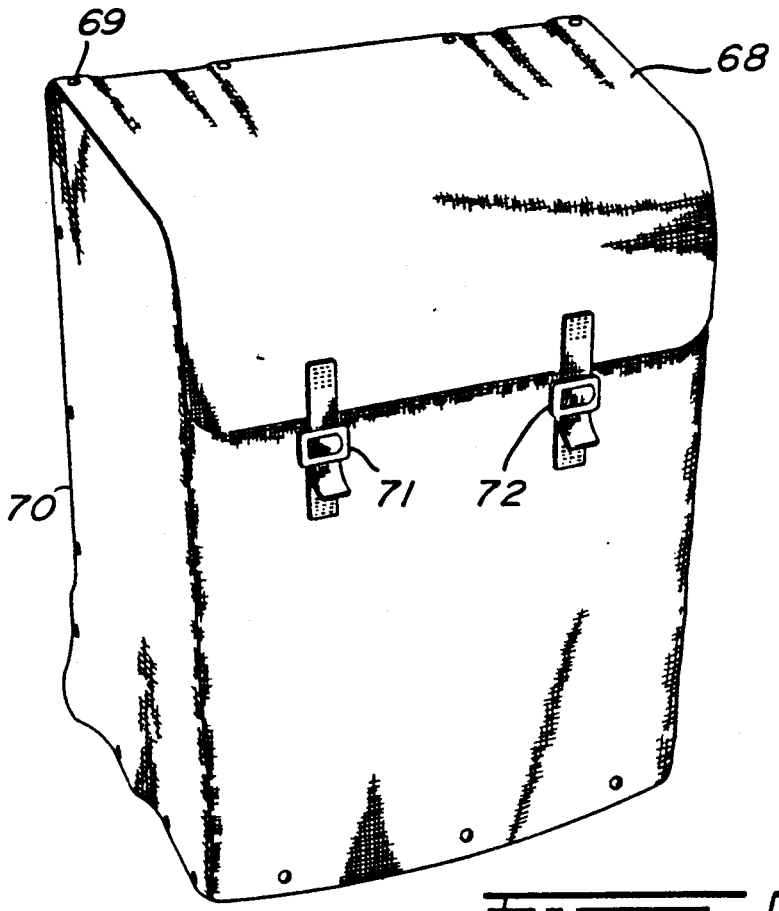
FIG. 9
FIG. 10
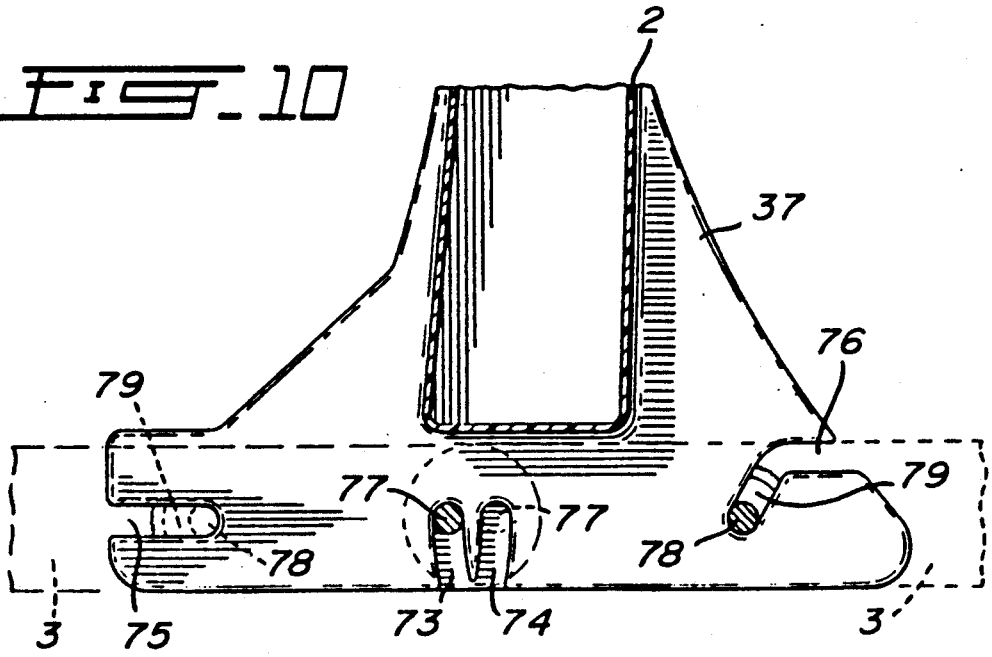

CONVERTIBLE CHAIR AND LOAD CARRIER DEVICE

BACKGROUND OF THE INVENTION

1. Field of the invention:

The present invention relates to a multipurpose device that can be converted either (a) into a carrier attachable to the back of a user person for load carrying purposes, or (b) into a chair for the user person.

2. Brief description of the prior art:

U.S. Pat. No. 2,480,402 granted to W. H. ELSTON on Aug. 30, 1949 proposes a convertible device of this type. More specifically, this patent describes a convertible boat chair and load carrier device.

This prior art device can first be converted into a chair attachable to a transverse boat seat to allow the user person to sit in the boat both safely and comfortably.

The seat and the back of ELSTON s chair can also be aligned with each other in the same plane to convert it into an outboard motor carrier. A harness is secured to the so obtained carrier to enable the user person to attach it on his back. A motor mounting support is also fixed to the carrier to support the outboard motor while it is transported.

A first drawback of ELSTON's device is its lack of versatility. Indeed, it is designed to carry only an outboard motor.

Another drawback of ELSTON s device is its complexity, which increases the manufacturing costs. It comprises numerous parts each having a different function. In particular, separate members form the seat of the chair and the outboard motor mounting support.

OBJECTS OF THE INVENTION

The main object of the present invention is therefore to eliminate the above discussed drawbacks of the prior art by providing a convertible chair and load carrier device which is (a) versatile as it can be used to carry loads of different types, and (b) simple in construction so that it can be manufactured at low cost using conventional methods.

Another object of the present invention is a convertible chair and load carrier device of which a single member forms either a member for supporting loads or the seat of a chair.

SUMMARY OF THE INVENTION

More particularly, the subject invention is concerned with a convertible chair and load carrier device comprising:

a dorsal member with first and second opposite faces;

means for attaching the dorsal member on the back of a user person with the first face thereof resting on the back of the person;

a load support member with first and second opposite faces; and means for mounting the load support member on the dorsal member either in first or second positions.

In its first position, the load support member is capable of supporting a load to thereby allow the user person to carry it on his back while in the second position of the load support member, this load support member forms the seat of a chair and the dorsal member the back of the same chair.

In accordance with a preferred embodiment of the convertible chair and load carrier device, the load support member is pivotally mounted on the dorsal member so that it can be pivoted between its first and second positions and locked in either one of these two positions.

The objects, advantages and other features of the present invention will become more apparent upon reading of the following non restrictive description of preferred embodiments thereof, given by way of example only with reference to the accompanying drawings.

BRIEF DESCRIPTION OF THE DRAWINGS

In the appended drawings:

FIGS. 4 and 5 are respectively side and top views, partially cross sectional, of the pivotal connections between the dorsal member and the load support member of the convertible device of FIGS. 1, 2 and 3;

FIG. 6 is a cross sectional view, taken along axis A—A of FIG. 2, of one of the shoulder straps of a harness allowing the user person to attach on his back the dorsal member of the convertible chair and load carrier device in accordance with the present invention;

FIG. 9 is a perspective view showing the device of the invention converted into a load carrier and provided with a removable packsack-like canvas cover for protecting the carried load against bad weather; and FIG. 10 is a partially cross sectional elevation view of another embodiment of the mechanical connection between the dorsal and load support members of the convertible chair and load carrier device in accordance with the present invention.

DETAILED DESCRIPTION OF THE PREFERRED EMBODIMENTS

Figure 1:
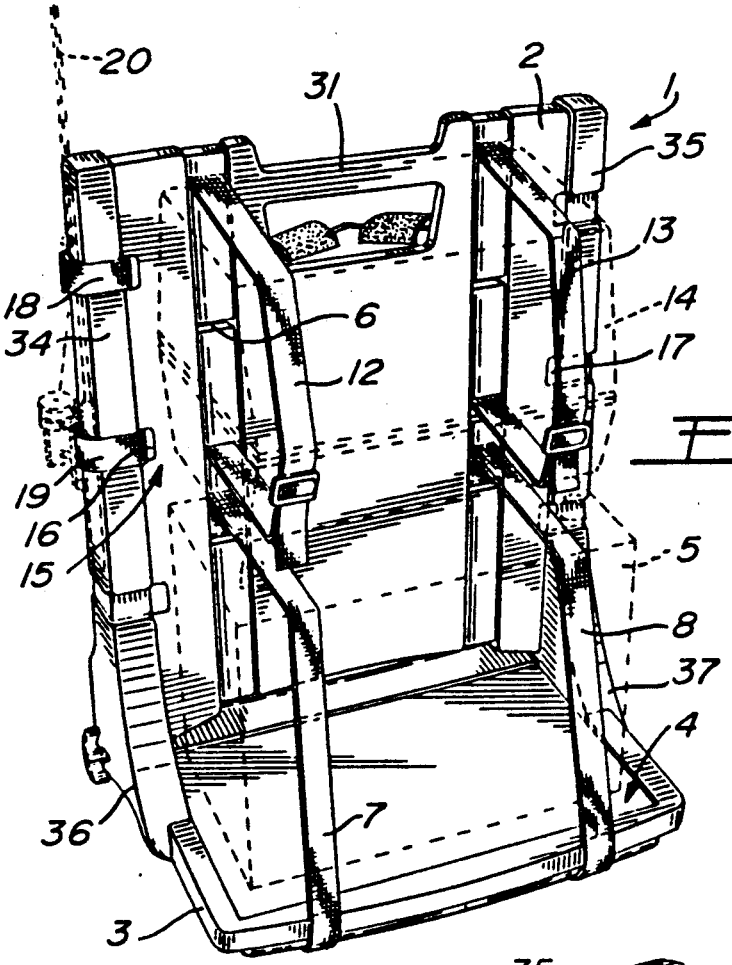
FIG. 1 is a perspective view of a convertible chair and load carrier device according to the invention, converted into a load carrier.
Figure 2:
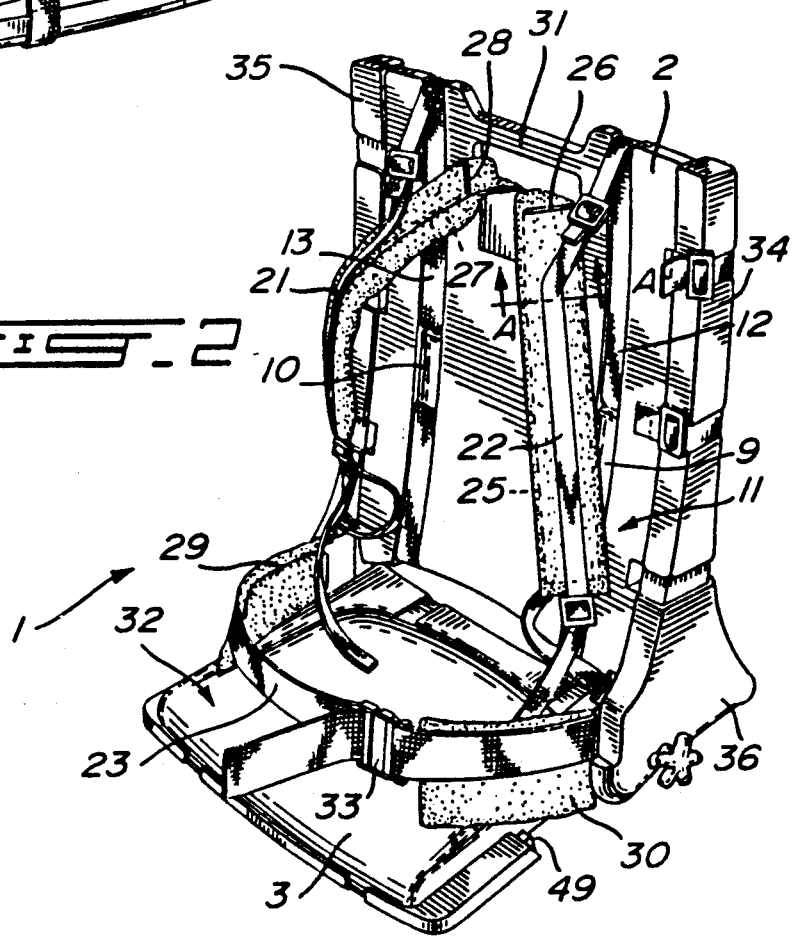
FIG. 2 is a perspective view of the device of FIG. 1, converted into a chair.

As illustrated in FIGS. 1 and 2, the convertible chair and load carrier device, generally identified by the reference numeral 1, comprises a dorsal member 2 and a load support member 3.

In FIG. 1, the device 1 is converted into a load carrier. The load support member 3 is then in a first, generally horizontal position with an upper face 4 that is hollowed out to receive a load such as a marine battery 5 (shown in dashed lines) for powering an electric outboard motor. The dorsal member 2 which is generally vertical is formed with a plurality of horizontal slots such as 6. A pair of straps 7 and 8 pass into two of these slots 6, into vertical grooves 9 and 10 formed on the face 11 of the dorsal member 2 (FIG. 2), and under the load support member 3 to encircle the battery 5 and thereby retain it onto the member 3.

Another pair of straps 12 and 13 can also be used to attach for example a fly box 14 (shown in dashed lines) on the face 15 of the dorsal member 2. Each strap 12,13 pass through a pair of horizontal slots 6 and in a respective one of the grooves 9 and On both side of the dorsal member 2 are also formed a plurality of vertical slots such as 16 and 17. As an example, short straps such as 18 and 19 pass through a pair of respective slots 16 and encircle a fishing rod 20 (illustrated in dashed lines) to attach the latter rod on the dorsal member.

As can be appreciated from FIG. 1 of the attached drawings, the device 1 of the invention is very versatile and can be used to carry a plurality of loads of different types.

Figure 3:
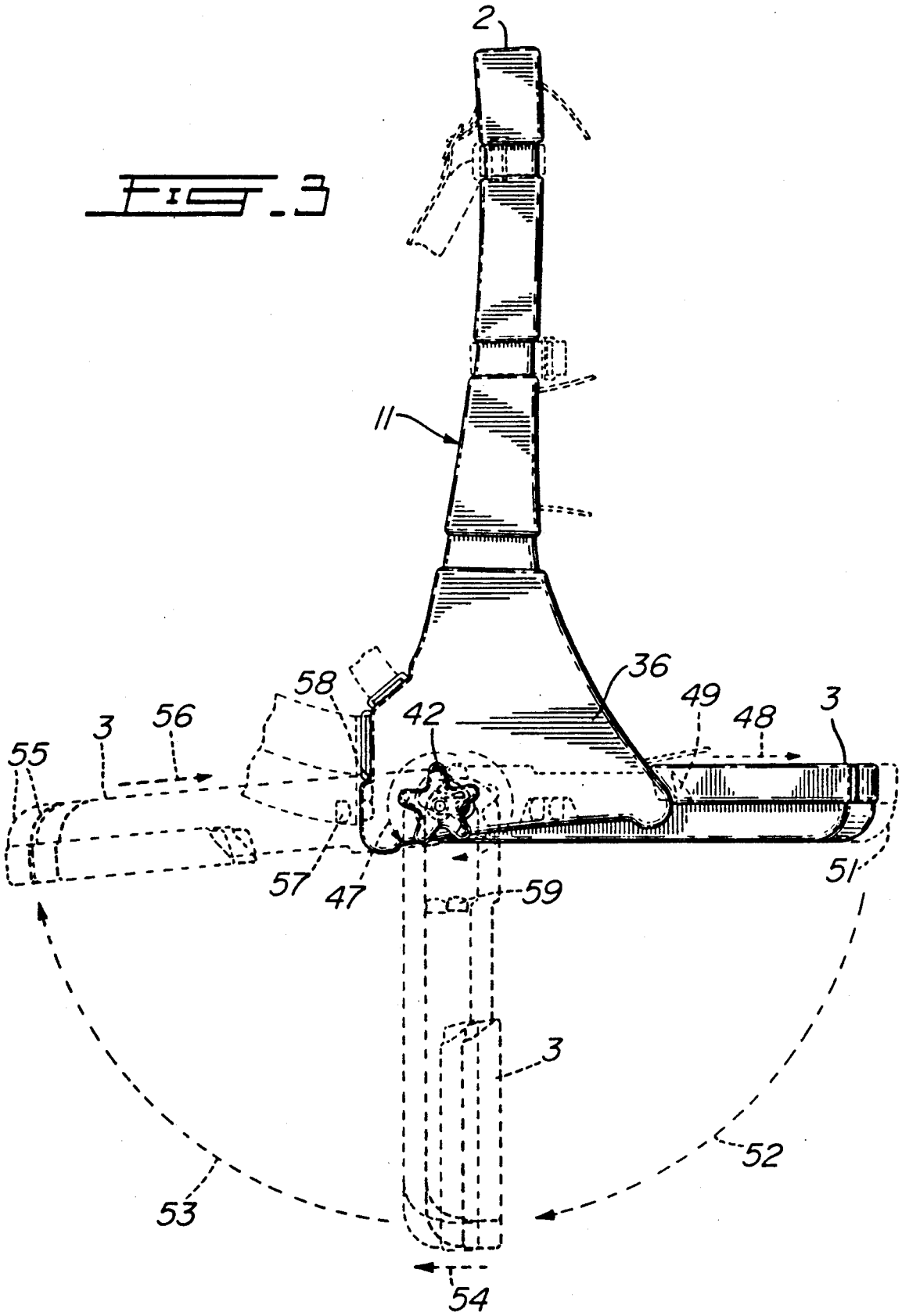
FIG. 3 is a side elevation view of the convertible chair and load carrier device of FIGS. 1 and 2, comprising a dorsal member on which is pivotally mounted a load support member.

As it is apparent from FIGS. 2 and 3, the face 11 of the dorsal member 2 is arcuate to present a concavity adapting the contour of the back of the user person. As the straps 7, 8, 12 and 13 are located in the grooves 9 and 10, they cause no discomfort to the user person. In order to attach the device 1 on the user person with the face 11 of the dorsal member 2 resting on his back, a harness including a pair of shoulder straps 21 and 22 as well as a belt 23 is provided. As shown in FIG. 6 which is a cross sectional view of the shoulder strap 22 taken along axis A—A (FIG. 2), each shoulder strap 21, 22 is padded with soft material 24 for the user's comfort. For a better support of the device 1 by the shoulders of the user person, a flat, substantially rigid, elongated and arcuate member 25 is inserted in a compartment formed in the shoulder strap 22 through a slot 26 (FIG. 2). As shown in dashed lines in FIG. 2, another flat, substantially rigid, elongated and arcuate member 27 is inserted into the shoulder strap 21 through a slot 28. The belt 23 also comprises inner pads 29 and 30 again for the user's comfort. Each belt 21,22 has its upper end secured to the upper end of the dorsal member 2, and its lower end attached to the belt 23. The two ends of the belt 23 are also secured to the respective sides of the dorsal member.

The harness of the convertible chair and load carrier device 1 is otherwise conventional and accordingly it will not be further described. In particular, the fixation of the shoulder straps 21 and 22 and of the belt 23 to the dorsal member 2 can be carried out in a plurality of different ways known to those skilled in the art. The present invention is obviously not limited to the type of such fixation.

To help in handling the device of the invention, the dorsal member 2 comprises an upper handle 31.

FIG. 2 of the drawings illustrates the device 1 converted into a chair. The load support member 3 is then in a position 180 degrees apart from its position as shown in FIG. 1, where the device 1 is converted into a load carrier. In the position illustrated in FIG. 2, the member 3 has an upper face 32 formed as a seat. The member 3 therefore constitutes the seat of the chair and the dorsal member 2 its back. Of course, the buckle 33 of the belt 23 can be detached and the harness moved away to clear the chair.

The connections which enable pivoting of the member 3 on the dorsal member 2 between its position shown in FIG. 1 and that of FIG. 2 will now be described in detail with reference to FIGS. 3, 4 and 5 of the appended drawings.

The dorsal member 2 is formed with two generally vertical side posts 34 and 35 each comprising a respective lower and triangular projection 36,37 (FIGS. 1 and 2). As illustrated in FIG. 3, the member 3 can be pivoted between the two projections 36 and 37. More specifically, a first pivotal connection is established between the projection 36 and the member 3, while a second, similar pivotal connection is established between the projection 37 and the load support member 3. In the following description, only one of these two connections will be discussed, that is the one corresponding to the projection 36, keeping in mind that the other pivotal connection is similar but symmetrical with respect to a central plane of symmetry of the convertible chair and load carrier device 1.

The pivotal connection comprises a pair of overlying cylindrical holes 38 and 39 formed on the outer face of the projection 36 (FIGS. 4 and 5). The overlying holes 38 and 39 have a bottom 40 interconnected to the inner face of the projection 36 through an oval slot 41. The pivotal connection also comprises a knob 42 secured at one end of a metallic rod 43 which is threaded at the other end. The knob 42 is formed with a cylindrical portion 44 structured to fit in either one of the overlying holes 38 and 39. The rod 43 traverses the slot 41 and has its threaded end screwed in a fastener 45 such as a nut, a threaded tube section, etc... embedded in the material of the load support member 3. Also, a tubular spacer 46 is mounted onto the rod 43 between the cylindrical portion 44 and the fastener 45.

When the device 1 is converted into a load carrier as shown in FIG. 1, the cylindrical portion 44 of the knob 42 is inserted in the hole 38 and a protuberance 49, integral with the member 3, is mated with a cavity 50 formed in the rear end of the projection 36. Also, as shown in FIG. 4, a laterally projecting stud 57, integral with member 3, rests on the upper wall of a cavity 59 formed into the material of the projection 36. This arrangement makes the load support member 3 stationary with respect to the dorsal member 2. Of course, a similar arrangement is present on the other side of the device 1.

When the device 1 is converted into a chair as shown in FIG. 2, the cylindrical portion 44 of the knob 42 is inserted in the cylindrical hole 39 and the stud 57 is mated with a cavity 58 formed in the front end of the projection 36. Again, this arrangement makes the member 3 stationary with respect to the dorsal member 2. Obviously, a similar arrangement is provided on the other side of the convertible chair and load carrier device.

In order to convert the device from a load carrier to a chair, the following operations are carried out, obviously on the two sides of the convertible chair and load carrier device;

the knob 42, fitted in hole 38, is unscrewed (see arrow 47 in FIGS. 3 and 5) until its cylindrical portion 44 is completely situated outside the hole 38 (see the dashed lines 60 in FIG. 5) whereby the tubular spacer 46 can slide into the slot 41;

the load support member 3 is then pulled in the direction 48 shown in FIGS. 3 and 5 until the rod 43 and spacer 46 reach their position shown by the dashed lines 61 in FIG. 5, in which the protuberance 49 disengages the cavity 50 (the cavity 59 is large enough to enable movement of the stud 57 as the member 3 is pulled as evidenced in FIG. 4 and 5);

the load support member 3 is pivoted in the direction indicated by the arrow 52 in FIG. 3 until it is generally vertical as illustrated in dashed lines;

the member 3 is translated in the direction 54 (FIG. 3) until the rod 43 and spacer reach their initial position;

the member 3 is again pivoted in the direction indicated by the arrow 53 in FIG. 3;

it is then pushed in the direction 56 to mate the stud 57 and cavity 58;

the knob 42 is finally screwed to fit the cylindrical portion 44 in the hole 39.

The device 1 is then converted into a chair.

To convert the device 1 from a chair to a load carrier, the inverse operations are carried out, starting with the last operation and ending with the first one. Such inverse operations will be apparent to those skilled in the art without the need of enumerating the same.

Figure 7:
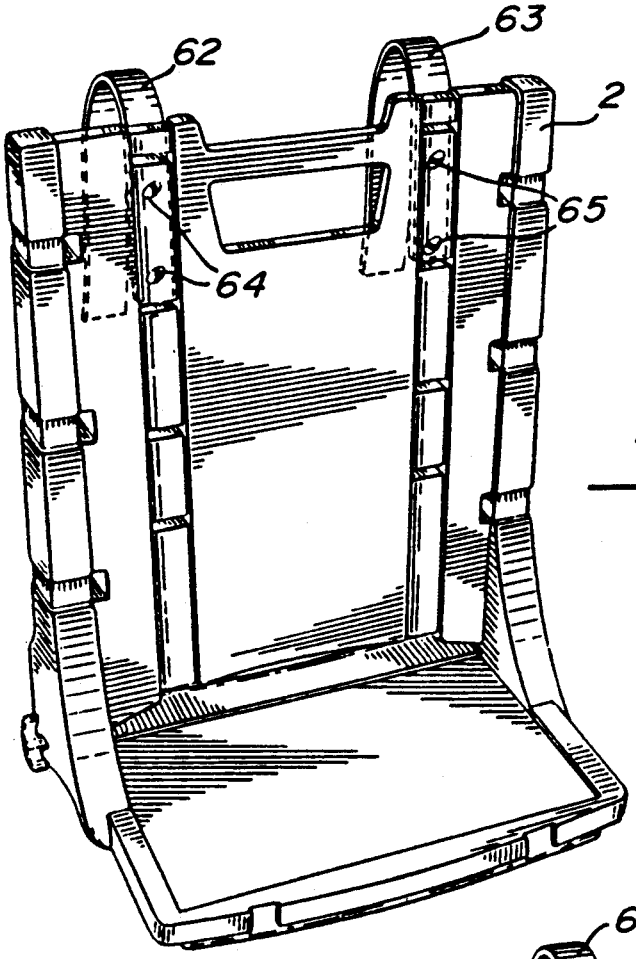
FIGS. 7 and 8 are perspective views of other embodiments of the convertible chair and load carrier device of the invention, including a pair of arcuate, strap-like and substantially rigid members for attaching the device on the back of the user person.
Figure 8:
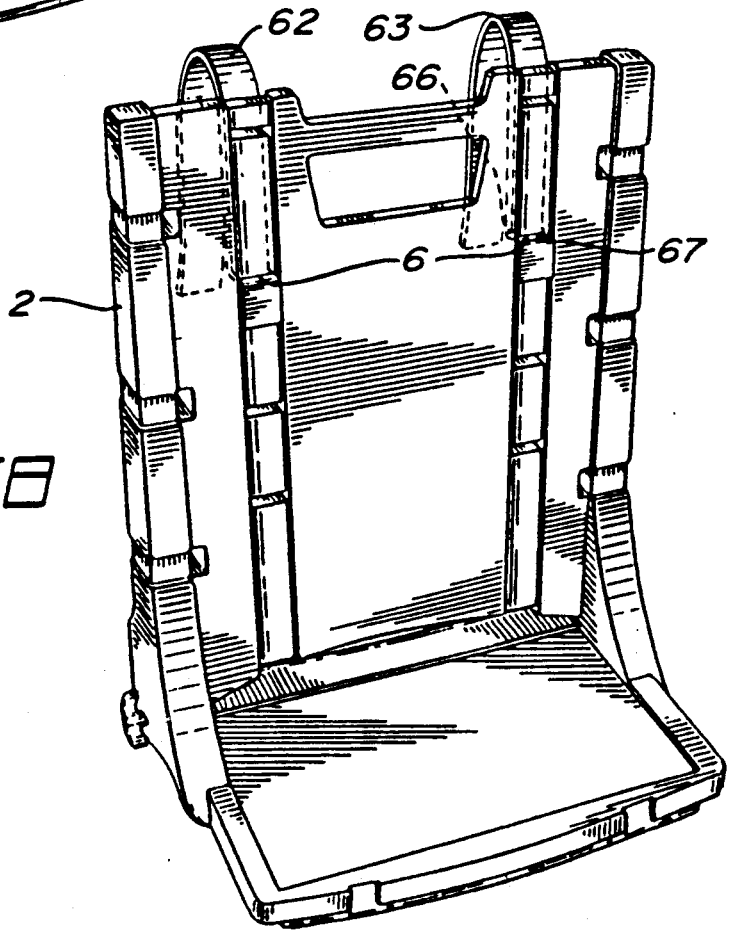

In FIGS. 7 and 8, the harness of FIG. 2 is replaced by a pair of elongated, substantially rigid, arcuate and flat shoulder members 62 and 63. These two flat members 62 and 63 are shaped to fit on the respective shoulders of the user person to attach the device 1 on his back. The arcuate members 62 and 63 are wide enough to ensure the comfort of the user person.

In accordance with a first embodiment as illustrated in FIG. 7, the shoulder members 62 and 63 are fastened to the dorsal member 2 through a respective pair of screws 64,65.

In the embodiment of FIG. 8, one end of each shoulder member 62,63 defines a first right angle such as 66 rearwardly and then a second right angle such as 67 downwardly. It is believed to be apparent that this shape of the ends of the shoulder members enables easy removal of these members 62 and 63 from two of the vertical slots 6 in the dorsal member 2 when the device 1 is used as a chair, and easy installation of these shoulder members in the slots 6 when the device 1 is used as a load carrier.

When the device 1 is converted into a load carrier, a packsack-like canvas cover 70 (FIG. 9) can be fixed to the device 1 to protect the carried article or articles against bad weather, in particular rain and snow. In the embodiment shown in FIG. 9, the cover 70 is secured to the device 1 through a plurality of press-studs such as 69 fastened to both the member 2 or 3 and the cover 70. The press-studs 69 enable easy removal of cover 70 as well as easy installation thereof on the device 1. The cover 70 can of course be opened and closed by means of a flap 68 attached through a pair of buckles 71 and 72. The convertible chair and load carrier device 1 can then be used as a packsack.

FIG. 10 illustrates another embodiment for the mechanical connection between the dorsal member 2 and the load support member 3. More specifically, a first groove 73 and a second groove 74 are formed on the inner face of each projection 36,37, as shown with respect to projection 37. A front, straight open slot 75 and a rear, angular open slot 76 are also formed in each projection 36,37. On both sides of the member 3 an integral stud such as 77 is provided while a nut-like threaded fastener is embedded in this member 3 to receive the threaded free end of a rod such as 78. Each rod 78 has a knob 79 fixedly secured at the end thereof opposite to its threaded end.

In order to convert the device 1 into a load carrier, the two rods 78 are slid into the respective slots 76 while the two studs 77 are inserted into the respective grooves 73. When the studs 77 and the rods 78 are in their positions of FIG. 10 in the grooves 73 and the slots 76, the knobs 79 are screwed to tighten the member 3 on the dorsal member 2. To remove the load support member 3 from the member 2 one has only to loose the knobs 79 and slide the studs 77 in the grooves 73 and the rods 78 in the slots 76 in the opposite direction.

To convert the device 1 into a chair, the member 3 is first turned upside down. The rods 78 are then slid into the front slots 75 while the studs 77 are inserted into the grooves 74. As the studs 77 and the rods 78 reach their positions of FIG. 10 in the grooves 74 and the slots 75, the knobs 79 and threaded rods 78 are tightened. Again, one has only to loose the knobs 79 and slide the studs 77 in the grooves 74 and the rods 78 in the slots 75 in the opposite direction to remove the member 3 from the dorsal member 2.

As can be appreciated, the load support member 3 can be separated from the dorsal member 2 in the embodiment of FIG. 10.

It is apparent from the cross sections of FIGS. 4, 5 and 10 that both the members 2 and 3 are hollow and can advantageously be made of plastic material through an adequate, conventional molding process. Accordingly, the device 1 is capable of floating when dropped in water so that it can be easily recovered. It can even be capable of floating when loaded provided that such load is not too heavy.

Although the present invention has been described hereinabove with reference to preferred embodiments thereof, such embodiments can be modified at will, within the scope of the appended claims, without departing from the nature of the subject invention.

What is claimed is:

1. A convertible chair and load carrier device, comprising:

a dorsal member with first and second opposite faces;

means for attaching said dorsal member on the back of a user person with said first face thereof resting on the back of the said user person;

a load support member with first and second opposite faces; and means for securing the load support member to said dorsal member either in first or second positions; wherein in its first position the load support member is capable of supporting a load to thereby allow the user person to carry it on his back, and wherein in the second position of the load support member, the said load support member forms the seat of a chair and the dorsal member the back of the said chair;

wherein said means for securing the load support member to said dorsal member comprises:

means for pivoting the load support member about the said dorsal member between said first and second positions; and means for locking on said dorsal member the load support member in either one of its first and second positions; and wherein said convertible chair and load carrier device has two sides, and said pivoting means comprises on each side of the said device:

said dorsal member formed with a lower projection defining opposite inner and outer faces;

a pair of overlying cylindrical holes formed in one of the inner and outer faces of the said lower projection, the overlying holes having a bottom;

an oval slot interconnecting the bottom of said holes with the other of said inner and outer faces of the lower projection, said slot extending in the two overlying holes;

a threaded, nut-like fastener fixedly secured to the load support member;

a rod with a first threaded end and with a second end;

a knob fixedly secured to the second end of said rod and comprising a cylindrical portion structured to fit in either one of the overlay holes;

wherein the cylindrical portion of the knob can be fitted in either one of the cylindrical holes with the said rod traversing the oval slot and with the threaded end of the rod engaging the nut-like fastener.

2. A convertible chair and load carrier device as defined in claim 1, in which said pivoting means further comprises a tubular spacer disposed on the said rod between the threaded fastener and the cylindrical portion of the knob.

3. A convertible chair and load carrier device as defined in claim 1, wherein said load means for locking the load support member in its first position comprises mating protuberances and cavities formed on the said lower projection and load support member.

4. A convertible chair and load carrier device as defined in claim 1, in which said means for locking the load support member in its first position comprises mating studs and cavities formed on the said lower projection and load support member.

5. A convertible chair and load carrier device as defined in claim 1, wherein said means for locking the load support member in its second position comprises mating studs and cavities formed on the said lower projection and load support member.

6. A convertible chair and load carrier device, comprising:

a generally vertical dorsal member with front and rear, opposite faces, and with a lower end;

means for attaching said dorsal member on the back of a user person with said front face thereof resting on the back of the said user person;

a load support member with first and second opposite faces, and with proximate and distal ends; and hinge means for hingedly attaching the proximate end of the load support member to the lower end of the dorsal member whereby said load support member can be pivoted about said dorsal member between (a) a first position in which the load support member extends rearwardly of the dorsal member and is generally perpendicular to the said dorsal member to form an L-shaped load carrier device, wherein in the first position the first face of the load support member is an upper face and is generally horizontal so that a load to be carried by the user person can be disposed thereon, and (b) a second position in which the load support member extends forwardly of the dorsal member to form a chair having a seat constituted by the second face of the load support member and a back constituted by the front face of the said dorsal member;

said hinge means comprising means for locking on said dorsal member the load support member in its first position and means for locking on said dorsal member the load support member in its second position.

7. A convertible chair and load carrier device as defined in claim 6, further comprising:

a packsack-like cover for covering the carried load, said packsack-like cover defining a peripheral band; and means for removably fixing the peripheral band of the said packsack-like cover on said dorsal and load support members when the said load support member is locked in its first position.

8. A convertible chair and load carrier device as defined in claim 6, wherein said means for attaching the dorsal member on the back of the user person comprises a pair of arcuate, substantially rigid elongated shoulder members attachable to the dorsal member and structured to fit on the respective shoulders of the user person in order to attach the said dorsal member on the back of said person, said convertible chair and load carrier device further comprising means for removably attaching the arcuate shoulder members to the said dorsal member, said removably attaching means comprising for each shoulder member a slot in said dorsal member and said shoulder member formed with an end bent to define a pair of successive angles whereby the latter end can be introduced in and removed from the said slot in order to attach to and remove from said dorsal member the said arcuate shoulder member.

9. A convertible chair and load carrier device as defined in claim 6, wherein said means for attaching the dorsal member on the back of the user person comprises a harness itself including a pair of padded shoulder straps, said harness further including an elongated, substantially rigid arcuate member inserted into each shoulder strap for improving support of the said device by the shoulders of the user person.

* * * * *